US007125283B1

(12) United States Patent
Lin

(10) Patent No.: US 7,125,283 B1
(45) Date of Patent: Oct. 24, 2006

(54) COAXIAL CABLE CONNECTOR

(75) Inventor: Hsiu-Yen Lin, Yun-Lin Hsien (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 11/256,105

(22) Filed: Oct. 24, 2005

(51) Int. Cl.
*H01R 9/05* (2006.01)

(52) U.S. Cl. ..... 439/578; 439/585

(58) Field of Classification Search ..... 439/578, 439/587, 584, 585; 29/281.1, 281.5
See application file for complete search history.

(56) References Cited

U.S. PATENT DOCUMENTS 5,083,943 A * 1/1992 Tarrant ..... 439/583
5,997,350 A * 12/1999 Burris et al. ..... 439/585
6,153,830 A * 11/2000 Montena ..... 174/88 C
6,425,782 B1 * 7/2002 Holland ..... 439/585
6,776,657 B1 * 8/2004 Hung ..... 439/578
6,805,584 B1 * 10/2004 Chen ..... 439/578
6,848,939 B1 * 2/2005 Stirling ..... 439/578
6,916,200 B1 * 7/2005 Burris et al. ..... 439/578
2004/0175990 A1 * 9/2004 Fox ..... 439/578

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

A coaxial cable connector comprises a head and a hollow cylinder. The hollow cylinder comprises a protective cylinder, a tubular shaft, and an elastic cylinder. The tubular shaft comprises a guide hole, a plurality of ladders, a locking flange, and a plurality of hooks. The elastic cylinder comprises a trench and a hook at one end and a locking ring defined by a notch near the other end. A bended metal tube having a stopper is mounted on the protective cylinder. In the coupling process, the coaxial cable inserts into the hollow cylinder. By using a pressure from a tool to break the notch of the elastic cylinder, the locking ring is separable from the elastic ring, and the locking ring shifts forward continuously along an inclined surface of the notch. Since the protective cylinder restrains the locking ring, the connector can couple with the coaxial cable tightly by pressing down the locking ring.

2 Claims, 5 Drawing Sheets

COAXIAL CABLE CONNECTOR

FIELD OF THE INVENTION

The present invention relates to a coaxial cable connector for enhancing the connection stability between the connector and the coaxial cable, and more particularly to a connector suitable to a wire such as coaxial cable or the like for use in signal transmission.

BACKGROUND OF THE INVENTION

In general cable TV system and common antenna TV system, the coaxial cable is spread to a splitter through a main line, and the coaxial cable is then further spread from the splitter to clients through secondary lines. As a result, the clients are capable of receiving signals from the TV system. The main line is connected to the splitter through a coaxial cable connector, which is mounted on the tail of the coaxial cable.

As shown in FIG. 5, the conventional coaxial cable connector such as a F type coaxial cable connector includes a main body A, wherein the main body A further includes a clamping tube A1, a pillar B coaxially located in the clamping tube A1, an O-ring C and a screw nut D located around the pillar B. The coaxial cable 80 is inserted into the terminal end A2 of the main body A by use of its free end so as to locate an insulating layer 82 and a center conductor 81 of the coaxial cable 80 in the pillar B. Besides, a cover net 83 and a cover 84 of the coaxial cable 80 are located between the pillar B and the clamping tube A1. By use of a hexagonal pressing tool for pressing the clamping tuber A1, the clamping tube A1 is tightly coupled to the cover 84 of the coaxial cable 80.

If there is a need to couple this connector with the coaxial cable, a hexagonal pressing tool must be utilized for coupling the six surfaces of the clamping tube A1 with the coaxial cable tightly. However, when in use, the contact degree between the clamping tube A1 and the coaxial cable 80 must be confirmed repeatedly. If the force is applied carelessly, the poor connectivity is caused. In view of the description mentioned above, the present inventor discloses a coaxial cable connector with simplified structure for enhancing connection tightness.

SUMMARY OF THE INVENTION

It is a main object of the present invention to disclose a coaxial cable connector with simplified structure and simple assembly.

In order to achieve the aforementioned object, the coaxial cable connector is disclosed. A coaxial cable connector comprises a head and a hollow cylinder. The hollow cylinder comprises a protective cylinder, a tubular shaft, and an elastic cylinder. The tubular shaft has a guide hole. A plurality of ladders and a locking flange are mounted at one end of the tubular shaft, and a plurality of hooks are formed at the other end of the tubular shaft. The elastic cylinder has a trench and a hook at one end and a locking ring defined by a notch near the other end. A bended metal tube having a stopper is mounted at one end of the protective cylinder. If there is a need to couple the hollow cylinder with the coaxial cable connector, the coaxial cable is inserted into the hollow cylinder from its backside. By using a pressure from a tool to break the notch of the elastic cylinder, the locking ring is separated from the elastic ring, and the locking ring shifts forward continuously along an inclined surface of the notch.

Since the protective cylinder restrains the locking ring, the coaxial cable connector can couple with the coaxial cable tightly by pressing down the locking ring.

The aforementioned aspects and advantages of the present invention will be readily clarified in the description of the preferred embodiments and the enclosed drawings of the present invention.

DETAILED DESCRIPTION OF THE PREFERRED EMBODIMENT

Figure 1:
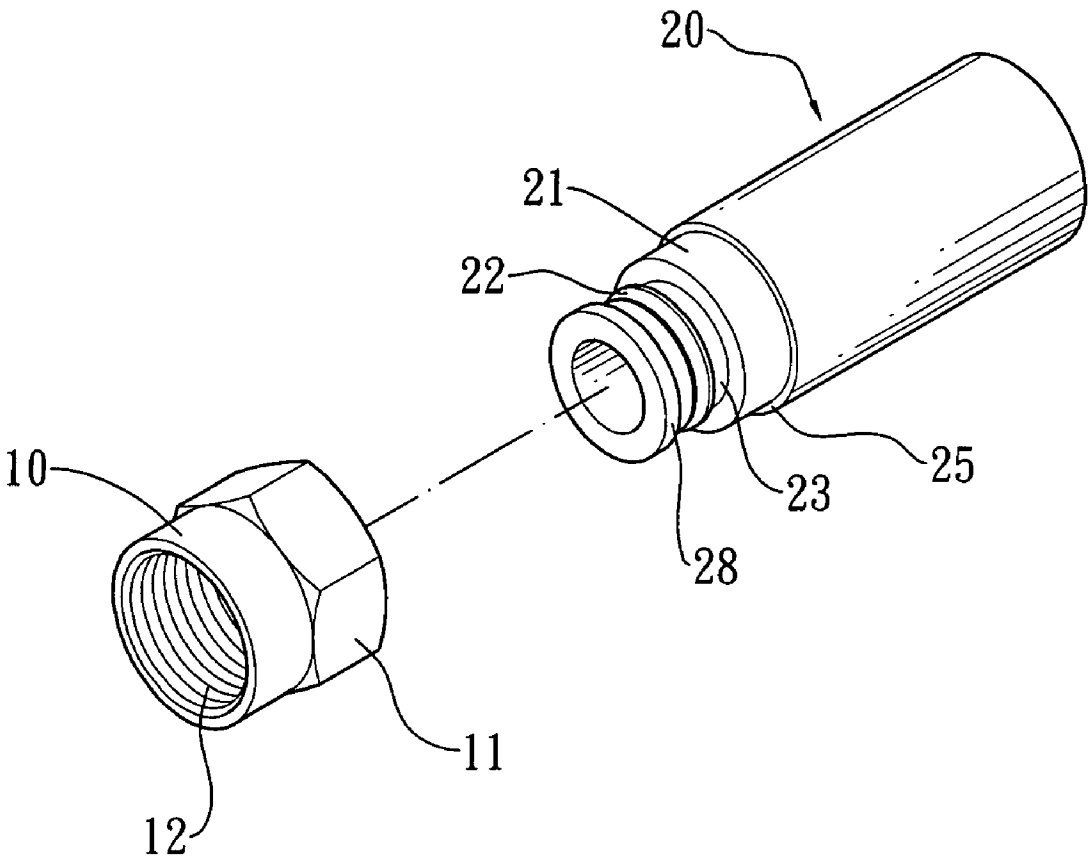
FIG. 1 is an elevational view showing the preferred embodiment of the present invention.
Figure 2:
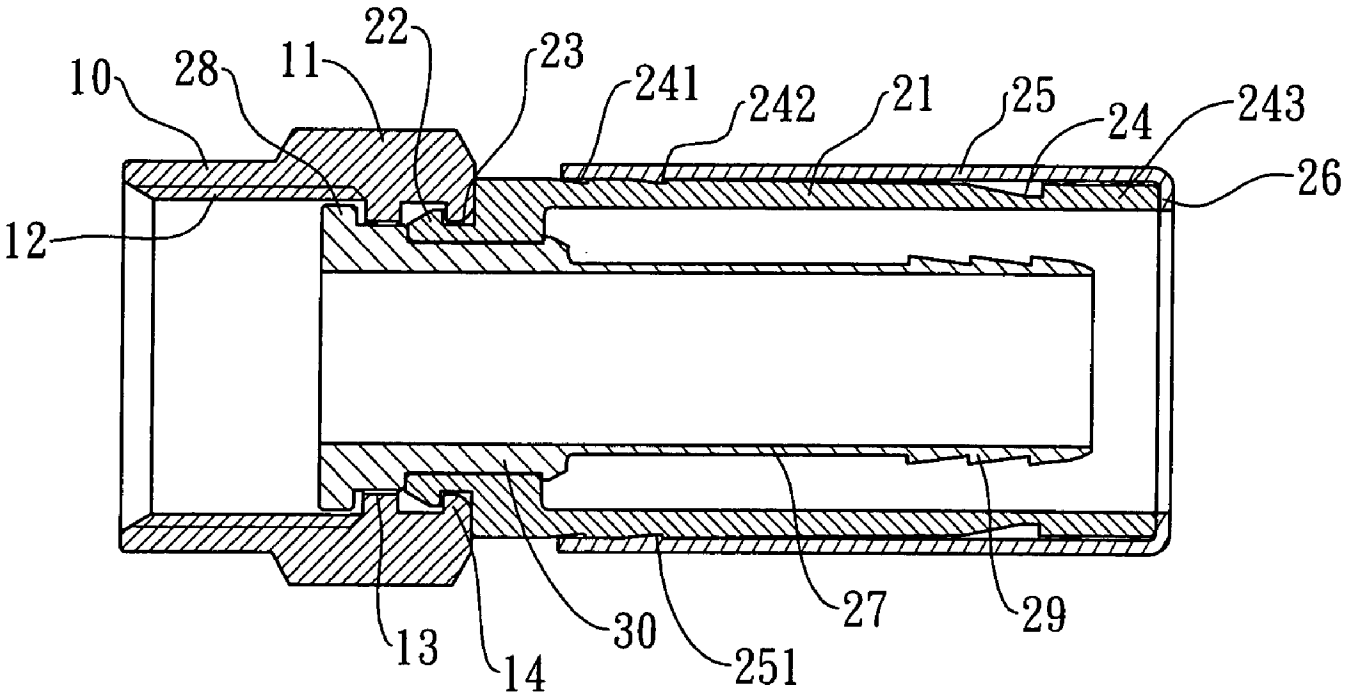
FIG. 2 is a cross-sectional view showing the assembled structure of the preferred embodiment of the present invention.

Referring to FIG. 1 and FIG. 2, a coaxial cable connector of the present invention comprises a head 10 and a hollow cylinder 20. In this preferred embodiment, a F type connector is illustrated. The head 10 of the F type connector has a hexagonal body 11 at its one end and a stopper 14 on the inside of the hexagonal body 11. The head 10 further has a plurality of internal screw threads 12 and a flange 13 around its inner surface.

The hollow cylinder 20 comprises an elastic cylinder 21, a tubular shaft 27, and a protective cylinder 25. A bended part is formed at one end of the inner edge of the elastic cylinder 21, wherein a trench 23 and a hook 22 are circularly formed at this end of the outside of the elastic cylinder 21. A notch 24 is circularly formed near the other end of the elastic cylinder 21 so as to define a locking ring 243 on the elastic cylinder 21 behind the notch 24. Besides, two recesses 241 and 242 are formed in proper positions in front of the notch 24. A guide hole is formed on the center of the tubular shaft 27, wherein a plurality of ladders 30 and a locking flange 28 are formed at one end of the outside of the tubular shaft 27. A plurality of hooks 29 are formed at the other end of the tubular shaft 27. The protective cylinder 25 is a short tube having a bended part 26 at one end, and made of metal material. A protrudent part 251 is mounted at the other end of the inner surface of the protective cylinder 25.

The elastic cylinder 21 is surrounded by the protective cylinder 25, and located to lean against the bended part 26 of the protective cylinder 25 by means of the locking ring 243 mounted at the terminal end of the elastic cylinder 21. The protrudent part 251 is inserted into the recess 242 of the elastic cylinder 21. After assembled, the tubular shaft 27 locks the flange 13 on the inner surface of the head 10 of the F type connector by use of the locking flange 28. Moreover, the hollow cylinder 20 leans against the stopper 14 of the head 10 by use of the hook 22 of the elastic cylinder 21.

Figure 3:
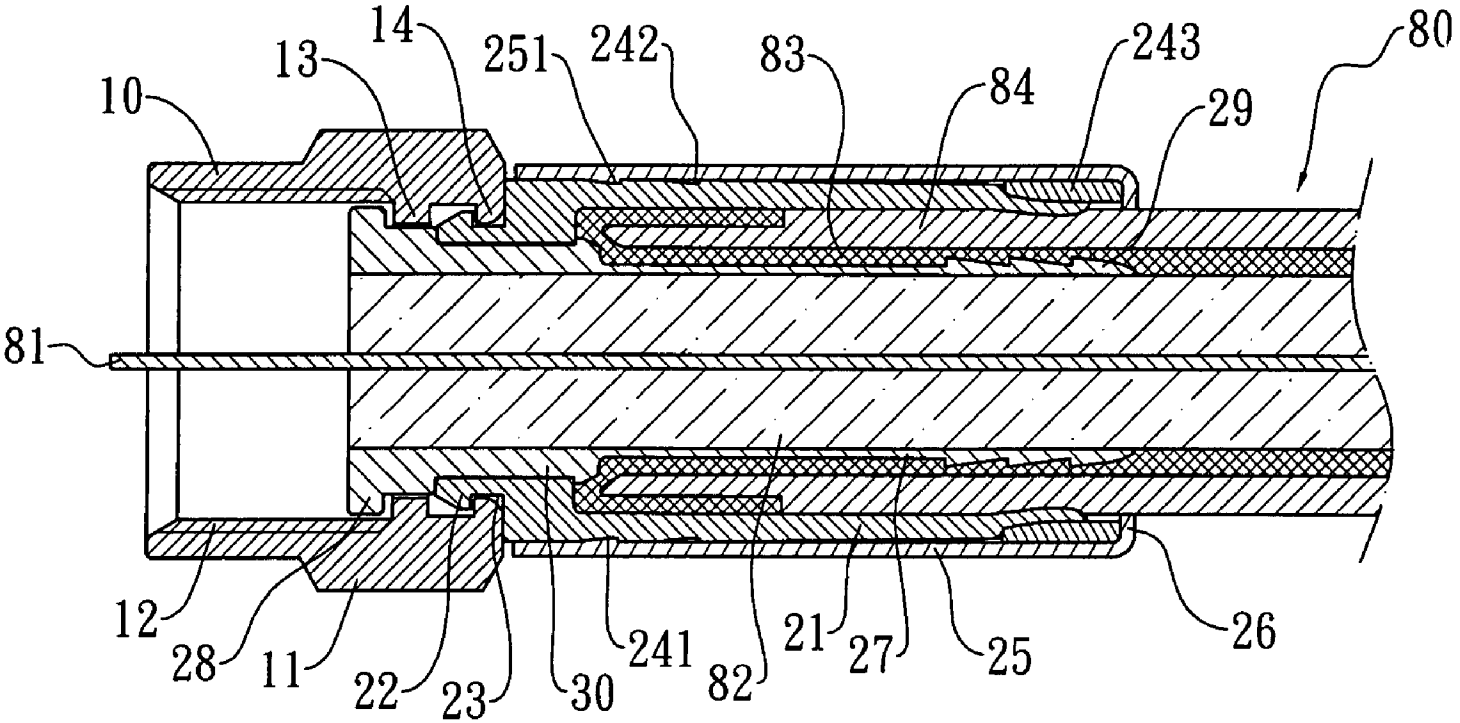
FIG. 3 is a cross-sectional view showing the practice of the preferred embodiment of the present invention.

As shown in FIG. 3, when in use, the coaxial cable 80 is inserted into the hollow cylinder 20 from its bottom so as to insert a center conductor 81 and an insulating layer 82 of the coaxial cable 80 into the tubular shaft 27. Besides, the tubular shaft 27 is covered with a cover net 83 and a cover 84. At this moment, an axial pressure from a tool is applied to break the notch 24 of the hollow cylinder 20 and separate the locking ring 243 from the elastic cylinder 21. Furthermore, the protective cylinder 25 is pressed continuously so as to push forward the broken locking ring 243 along an inclined plane of the notch 24 until the protrudent part 251 is shifted forward from the recess 242 to the recess 241. As a result, the rear end of the elastic cylinder 21 can be pressed down since the locking ring 243 is restrained by the protective cylinder 25. By compressing and deforming the locking ring 243 and the elastic cylinder 21, the cover net 83 and the cover 84 can be coupled to the hooks 29 of the tubular shaft 27 tightly.

Figure 4:
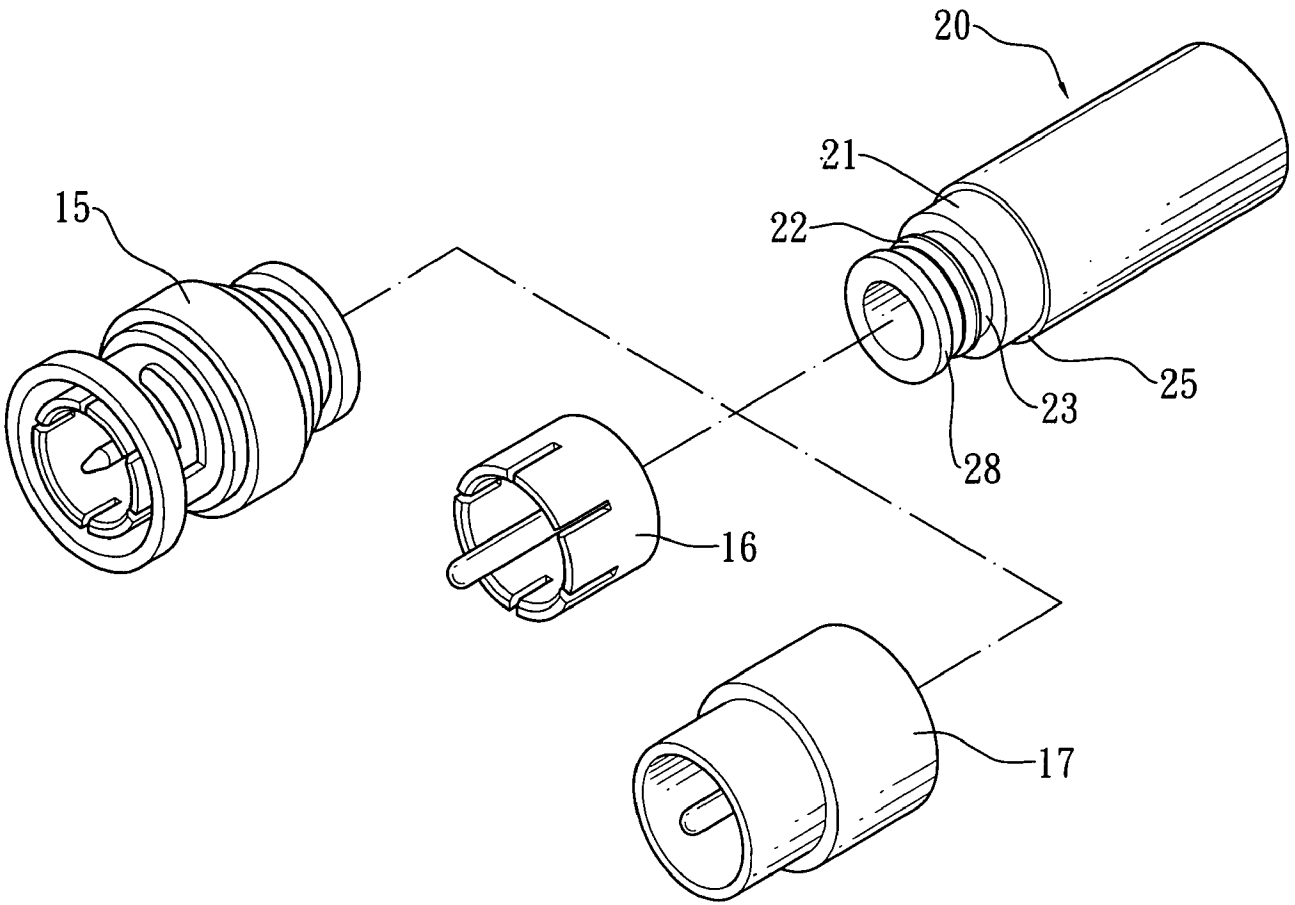
FIG. 4 is a schematic view showing that the hollow cylinder is suitable to various connectors.
Figure 5:
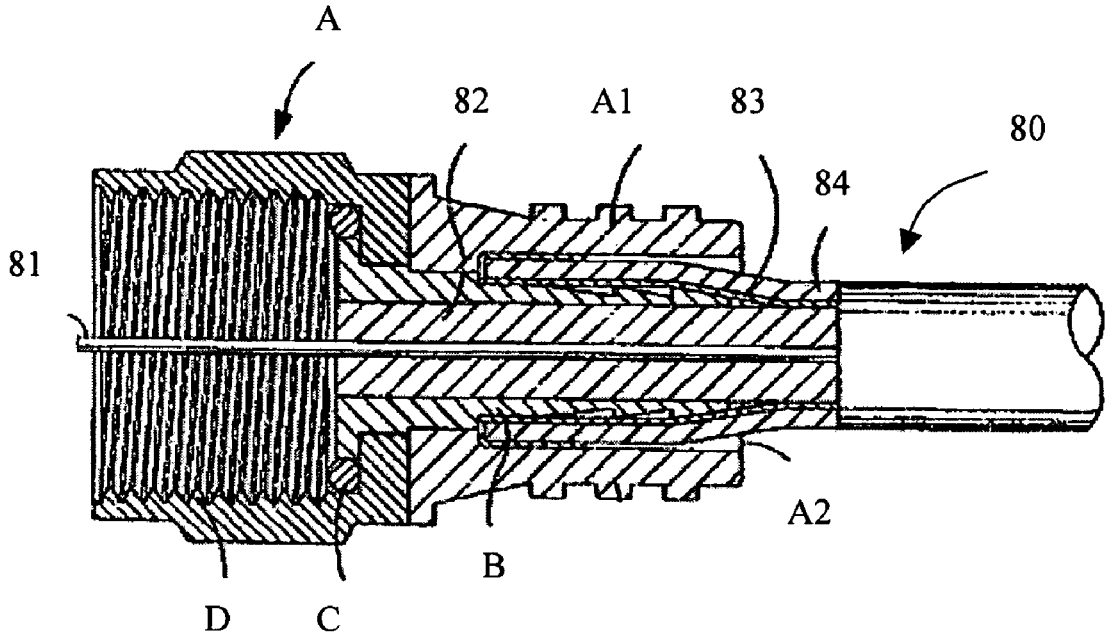
FIG.5 (Prior Art)
FIG. 5 is cross-sectional view showing the practice of the conventional coaxial cable connector.

Furthermore, as shown in FIG. 4, the hollow cylinder 20 is designed for use in various connectors, such as BNC connector 15, RCA connector 16, IEC connector, etc., and providing a convenient and excellent clamping method. By use of the notch 24 and the locking ring 243 of the elastic cylinder 21, the coaxial cable connector can be coupled to the coaxial cable tightly.

It is apparent that the coaxial cable connector disclosed in the present invention provides the following advantages, wherein:

1. The simplified structure provides convenience to assembly and usage, and steadies the connection between the hollow cylinder and the coaxial cable by simply use of the tool.

2. The protective cylinder of the hollow cylinder is made of steel so that the coaxial cable and the coaxial cable connector can be tightly connected to one another as long as the notch is broken and the locking ring is pressed.

On the basis of the aforementioned description, it is apparent that the coaxial cable connector of the present invention achieves the expected purposes and fills all requirements for a patent. Accordingly, the present invention is submitted for a patent.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

The invention claimed is:

1. A coaxial cable connector comprising:

a head; and a hollow cylinder comprising:

a tubular shaft having a guide hole on a center;

an elastic cylinder having a trench and a hook at one end and a locking ring defined by a notch near the other end; and a protective cylinder having a bent metal tube at one end, wherein the coaxial cable connector is configured to be coupled with a coaxial cable by the steps of: inserting the coaxial cable into the hollow cylinder; aligning a front end of an insulating layer mounted on the coaxial cable with a front end of the tubular shaft; using a tool for breaking the notch of the elastic cylinder and separating the locking ring from the elastic ring; shifting the locking ring forward continuously along a top surface of the notch, after shifting, the locking ring continuously applies pressure against the elastic cylinder through a restraining force exterted by the protective cylinder against the locking ring in order to tightly couple the coaxial cable with the coaxial cable connector.

2. The coaxial cable connector of claim 1, wherein the coaxial cable connector is a F type connector, a BNC connector, a RCA connector, or an IEC connector.

* * * * *